US009050625B1

(12) United States Patent
Bonachea Ruiz

(10) Patent No.: US 9,050,625 B1
(45) Date of Patent: Jun. 9, 2015

(54) FLOOR GROUT INSTALLATION APPARATUS AND METHOD

(71) Applicant: Rudy Ammed Bonachea Ruiz, Miami, FL (US)

(72) Inventor: Rudy Ammed Bonachea Ruiz, Miami, FL (US)

( * ) Notice: Subject to any disclaimer, the term of this patent is extended or adjusted under 35 U.S.C. 154(b) by 0 days.

(21) Appl. No.: 13/734,336

(22) Filed: Jan. 4, 2013

Related U.S. Application Data

(60) Provisional application No. 61/583,361, filed on Jan. 5, 2012.

(51) Int. Cl.
*B05D 3/12* (2006.01)
*B05C 9/12* (2006.01)

(52) U.S. Cl.
CPC .... *B05D 3/12* (2013.01); *B05C 9/12* (2013.01)

(58) Field of Classification Search
CPC ..... E04F 21/165; B05C 9/12; B05D 3/12
USPC ..... 222/611.2; 118/313, 323; 401/16, 137; 425/62
See application file for complete search history.

(56) References Cited

U.S. PATENT DOCUMENTS 4,684,042 A * 8/1987 Strickler et al. ..... 222/327
4,781,556 A * 11/1988 Paul ..... 425/62
6,260,743 B1 * 7/2001 Mazzenga ..... 222/611.2

* cited by examiner

*Primary Examiner* — Xiao Zhao
(74) *Attorney, Agent, or Firm* — H. John Rizvi; Gold and Rizvi P.A.

(57) ABSTRACT

The present invention is related to a floor grout installation apparatus and its method of use. The apparatus not only applies grout to fill spaces between floor tiles but also includes means for removing grout from the surface of the tiles after the grout has been applied and cleaning the tile as it passes.

19 Claims, 10 Drawing Sheets

208
231
234
232
230
241
202
204
212
220
133
205
223
206
222
200
129
131
130
298
299

FLOOR GROUT INSTALLATION APPARATUS AND METHOD

CROSS REFERENCE TO RELATED APPLICATIONS

This application is a Non-Provisional Application claiming the benefit of Provisional Patent Application Ser. No. 61/583,361, filed on Jan. 5, 2012, which is included herein by reference in its entirety.

BACKGROUND OF THE INVENTION

1. Field of the Invention

The present invention relates generally to an apparatus which applies grout material between floor tiles and removes excess grout left on the surface of the tiles after application of the grout, and the method for using same. More particularly, the invention is directed to a floor grout installation apparatus and method for using the apparatus to apply grout into spaces between floor tiles at a speed that is much faster than can be accomplished by manual methods used in the art, with the apparatus also removing any excess grout left on the surface of the tiles after upstream application thereof.

2. Description of the Prior Art

Tiles are typically held in place by cement, also known as mud, or other suitable adhesives, such as epoxy, mastic, and the like. Grout is a non-adhesive material that is applied between tiles to fill voids between adjacent tiles. Grout typically comprises a mixture of water, cement, sand, and may further include a color tint, and/or fine gravel. It is applied as a thick liquid and hardens over time, much like mortar. Grout is not flexible, and cannot expand and contract with changing temperatures.

To allow sufficient curing time for the adhesive, grout is usually applied at least fourteen to sixteen hours after the tiles have been set.

Excess grout must be removed as soon as application thereof is completed, as it is very difficult to remove excess grout from the surface of the tiles once it has cured. The most common procedure used to remove such excess grout from the surface of the tiles is to manually sponge off the excess material with a wet sponge; a procedure which is labor intensive and time consuming.

Other procedures and tools are known for use in removing excess grout from the surface of floor tiles. A common flat head screwdriver has also been used to scrape grout from tile surfaces. However, this method has drawbacks. Due to the small flat area provided at the tip of the conventional screwdriver, only a small amount of excess grout can be removed at a time.

Another tool in common use has a handle and stem resembling those of a screwdriver, but which terminates at its distal end with a metallic triangularly shaped scraper head. The terminal edge of the blade and corners of the triangle have utility in removing cement.

Another tool known as a grout/caulk packer is used in the manual process to form a concavity along the linear extent of the grout or caulk via a spherical member mounted at a distal end of a handle of the packer.

Another complex manual device used to remove excess grout comprises a wide blade adapted to remove excess grout and caulk, a four-armed cement remover and grout joint spacer, a spherical grout packer and a V-shaped grout and caulk profiler. These structures are adapted to be secured to a hollow handle of the device in varying combinations.

Another device includes a tile adhesive removal system having a handle provided with one or more removable tips. A properly-sized tip is selected for a particular channel width, and is removably attached to the handle. The tip removes any excess adhesive from the channel between tiles, and is then cleaned for use with the next tile. The removal system may include an orienting element, so that the tip is not inserted upside down.

Also, a brush for a rotary floor machine specially adapted to clean grout from tile surfaces has been proposed. The brush includes a disk having a plurality of bores arranged into a plurality of rings disposed about one face of the disk. Each ring defines an arcuate pattern of alternating first and second bores, with the first bores angled radially inwardly and the second bores angled radially outwardly. Tufts of bristles disposed within the first and second bores thus form areas of overlapping bristles.

Even though the above defined devices for applying grout to tiles or for cleaning grout from tile surfaces exist, a single labor and time saving floor grout installation and tile surface cleaning apparatus and method of use are still desired.

SUMMARY OF THE INVENTION

This invention is directed to a floor grout installation apparatus and method. The apparatus not only applies grout between floor tiles but cleans grout from the surface of the tiles almost immediately after application thereof.

In one general aspect of the present invention, the apparatus comprises a chassis on a set of adjustable transport wheels, the chassis including a framework which mounts a set of work wheels, water tanks, a motor, and a plurality of cooperating rollers about which a continuous grout removing belt is installed, and a grout installation device upstream of the belt.

Accordingly, it is a primary object of the present invention to provide a floor grout installation apparatus capable of applying grout between tiles and immediately cleaning excess grout from tiles surfaces in a labor and time saving manner.

Finally, a method for using the apparatus is also disclosed.

These and other aspects, features, and advantages of the present invention will become more readily apparent from a perusal of the attached drawings and the detailed description of the preferred embodiment, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the various views of the drawings.

DETAILED DESCRIPTION OF REPRESENTATIVE EMBODIMENT

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
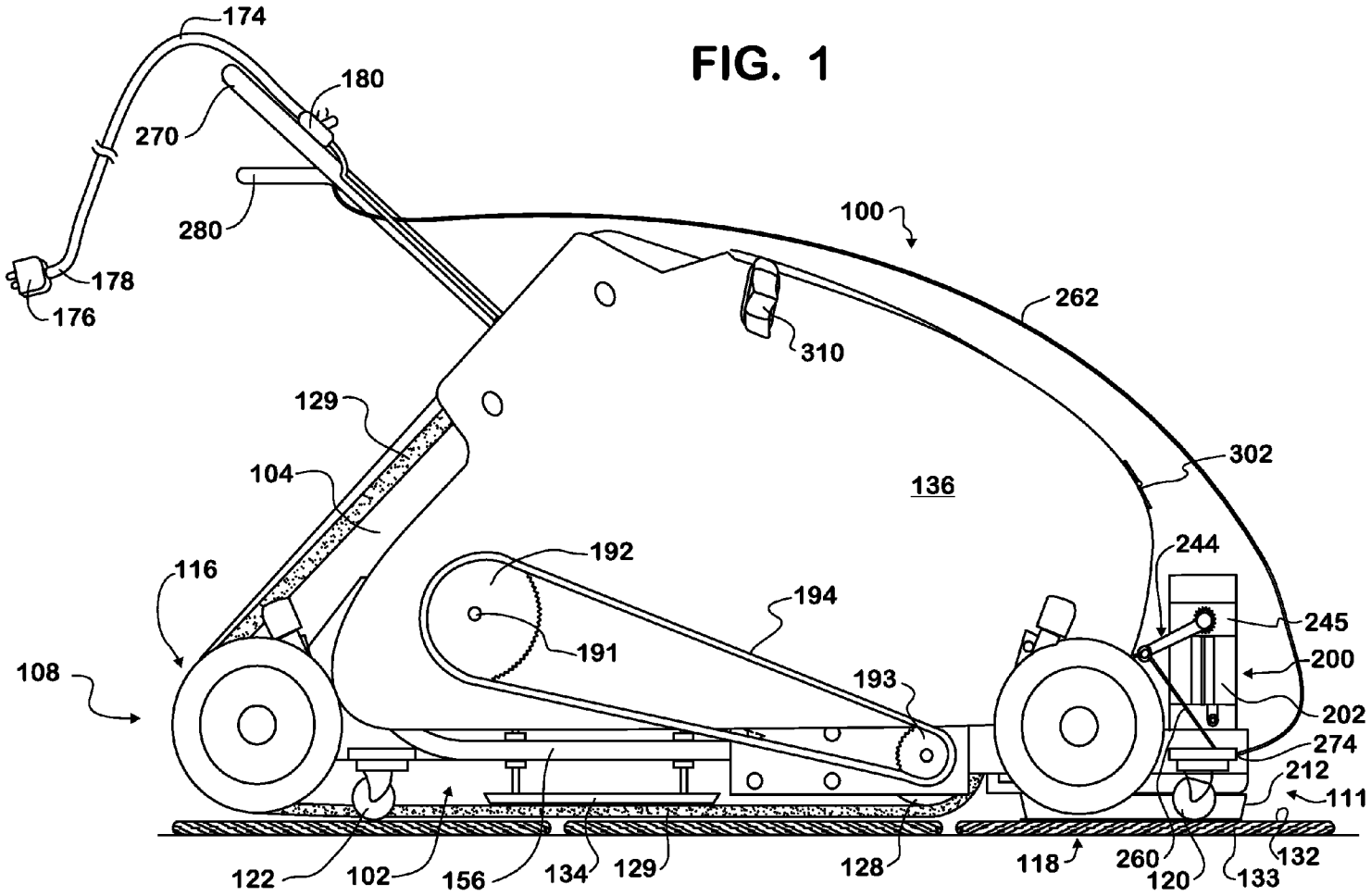
FIG. 1 is a side elevation view of the floor grout installation apparatus made in accordance with the teachings of the present invention showing the apparatus configured for use in its work environment.
Figure 2:
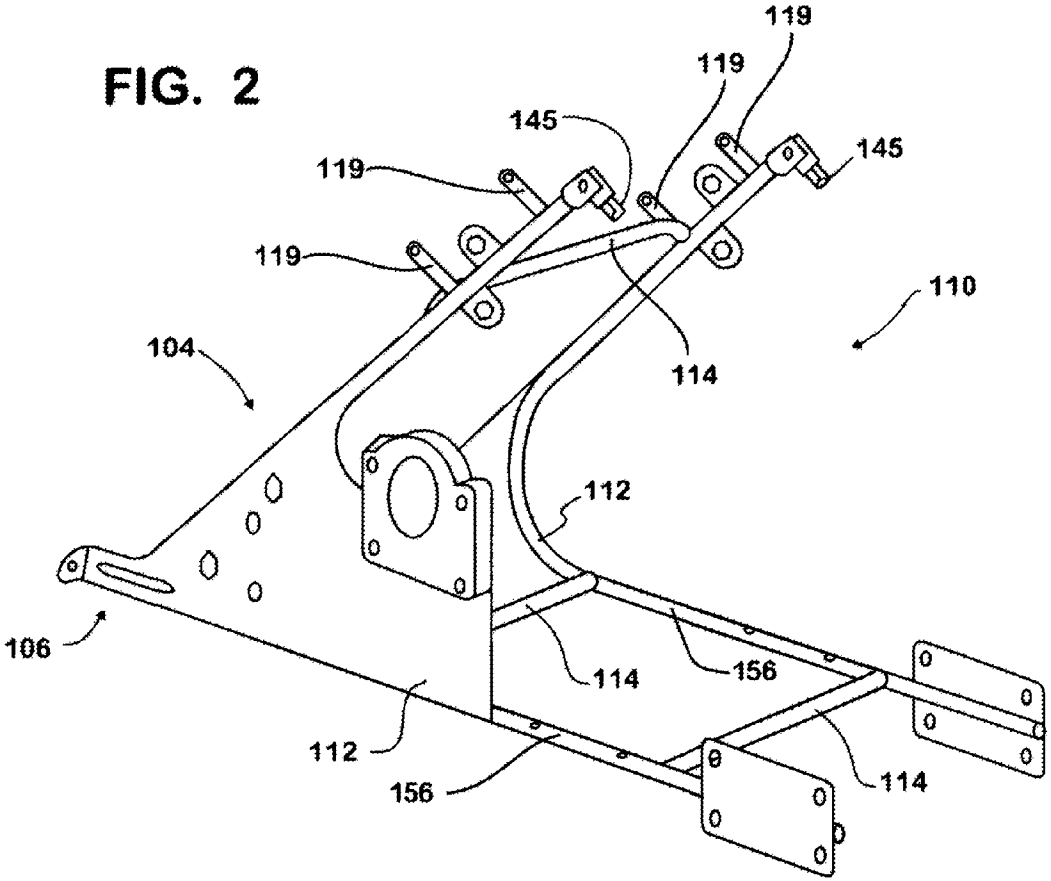
FIG. 2 is an isometric view of a framework mounted on a chassis of the apparatus, which is suitably configured to engage various structures of the apparatus thereon and thereto.

As illustrated throughout the Figures, the invention is directed to a floor grout installation apparatus 100 and its method of use. Beginning with a description of the apparatus 100, it is seen to includes a bent tube chassis 102 upon which various structures thereof are engaged through provision of a framework 104 (FIG. 2) mounted on the chassis 102. The framework 104, as shown in FIG. 2, is in the form of a V which is laid on its side, with a tip 106 of the V being positioned toward a rear 108 (FIG. 1) of the apparatus 100 and an open end 110 thereof being positioned toward a front 111 (FIG. 1) of the apparatus 100. The framework 104 is seen to comprise two parallel, mirror image sidewalls 112 linked together by a plurality of cross member 114, the framework 104 to be defined in greater detail herein below.

Figure 3:
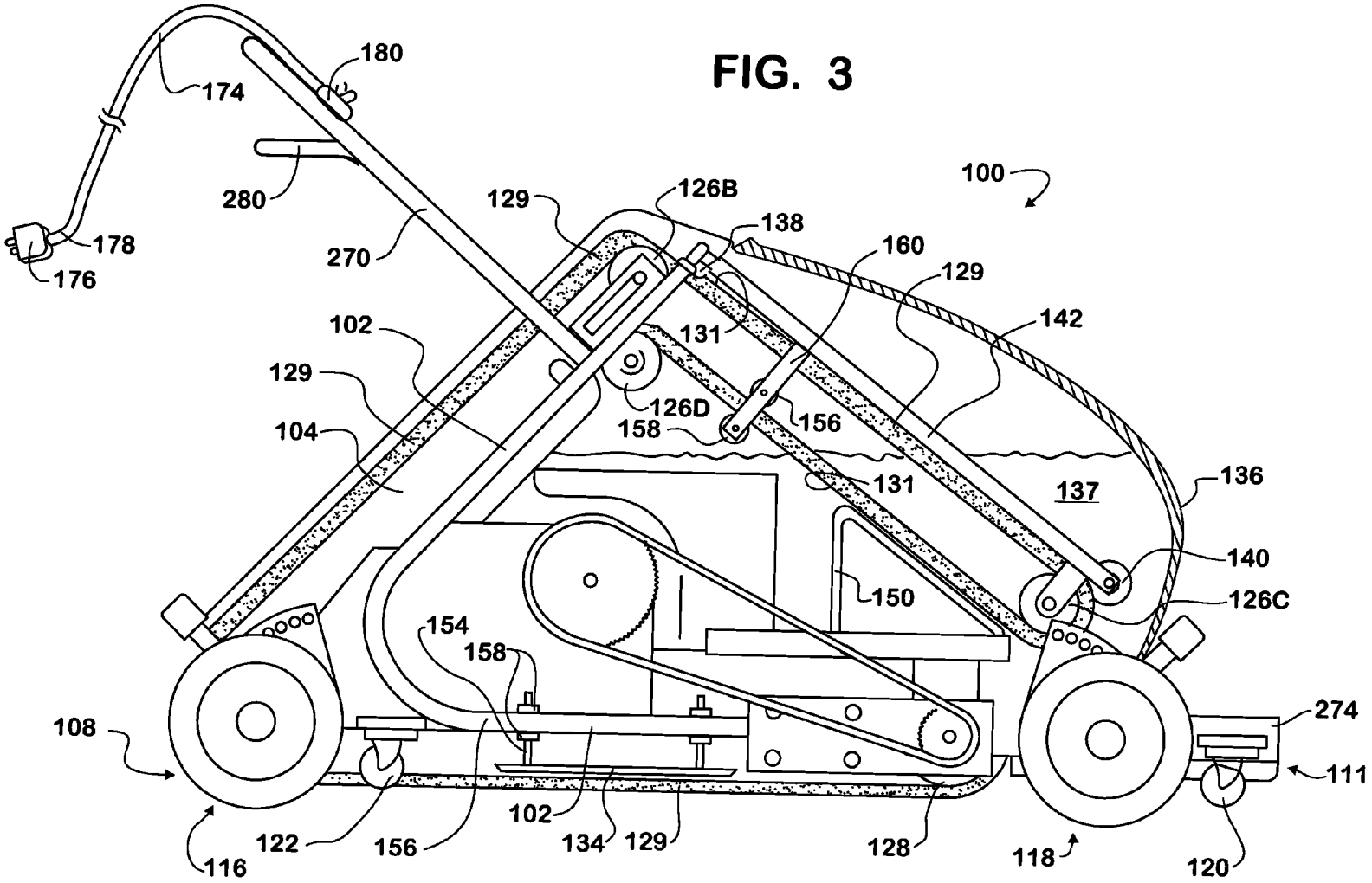
FIG. 3 is a partially sectioned side elevation view similar to that of FIG. 1 wherein the apparatus is shown configured for transport and wherein portions are removed to show the interior elements of the apparatus.

Returning now to FIG. 1, also mounted to chassis 102, are two sets of adjustable transport wheels 116 and 118. The set of wheels 116 mounted at the rear 108 of the apparatus 100 are larger than the set of wheels 118 mounted at the front 111 of the apparatus, the sets of wheels 116 and 118 being used for transport of the apparatus 100 to its intended location of use, as best illustrated in FIG. 3. These wheels 116 and 118 are adjustable to allow for elevation of the chassis 102 and attached framework 104 for transport and allow for descent of the chassis 102 and attached framework 104 to a work position, as illustrated in FIG. 1, the chassis 102 and framework 104 then being carried by two sets of fixed position wheels 120 and 122, respectively, mounted to the framework toward the front area 111 and the rear area 108 of the apparatus 100.

Figure 5:
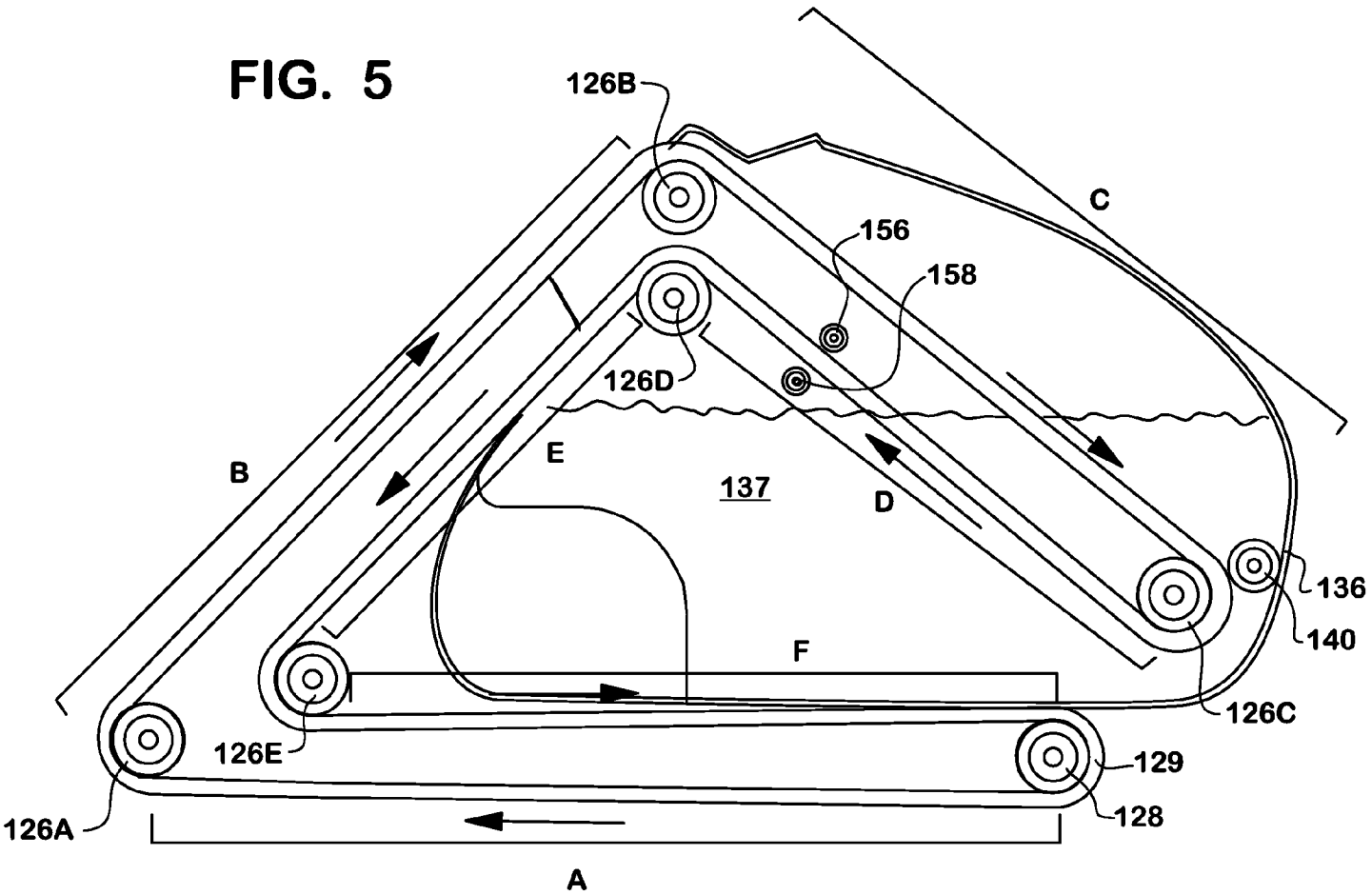
FIG. 5 is side elevation view showing flights of a continuous belt of the apparatus.
Figures 11, 12, 13:
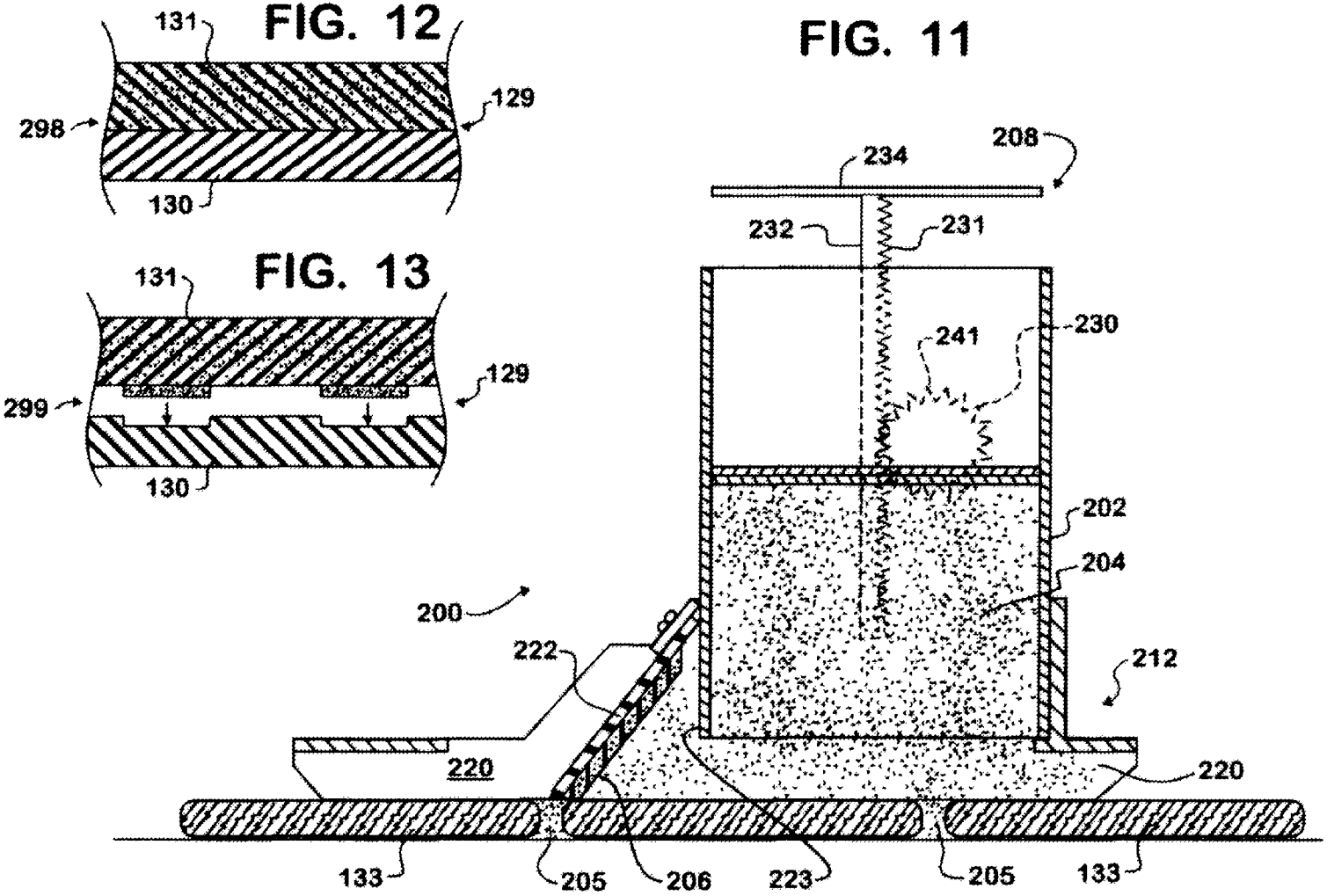
FIG. 11 is a cross sectional view through the grout applicator showing how same is functional in applying grout.
FIG. 12 is an enlarged partial cross sectional view of the continuous belt showing same to comprise a supporting layer and a sponge layer attached thereto, such as by a suitable adhesive.
FIG. 13 is a partial cross section of the continuous belt showing the sponge layer attached to the supporting layer with dense hook and loop tape.

Mounted also to the framework 104, in a desired pattern, either directly or indirectly, are a plurality of free rollers 126A, 126B, 126C, 126D, and 126E and one driven roller 128, as best illustrated in FIGS. 3 and 5. About the rollers 126A-E and 128 is mounted the continuous grout removing belt 129. This belt 129 is made of a rubber base 130 over which and to which a sponge or spongy layer 131 is suitably attached, as illustrated in FIGS. 12 and 13. The belt 129 is used in contacting a top surface 132 of tiles 133 there beneath to sponge excess grout from the tile surface 132 after grout 204 (FIG. 11) has been appropriately applied with the apparatus 100, as shown in FIG. 1.

Figure 8:
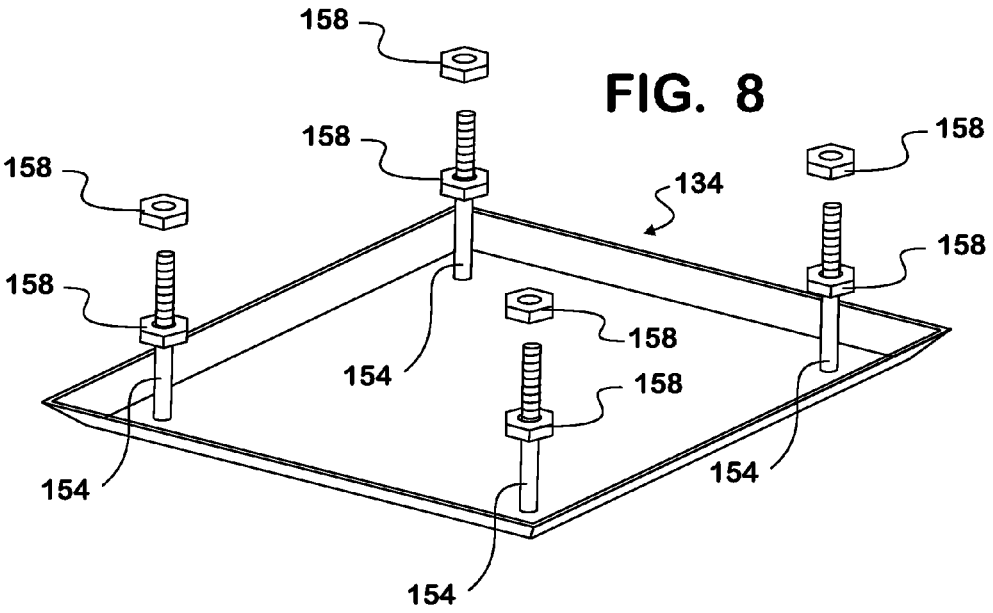
FIG. 8 is a partially exploded isometric view of a belt compression plate or platen which compresses the continuous belt against an underlying surface of the apparatus, the tile surface, when in work mode.

The belt 129 is configured about the rollers 126A-E and 128 to have six flights, labeled A, B, C, D, E and F, respectively. Flight A is the bottom most flight and the belt 129 travels horizontally about driven roller 128 and free roller 126A and is pressed against the underlying tile surface 132 by a compression plate or platen 134, as shown in FIG. 8. Flight A travels rearwardly and then turns and takes flight B, the rearmost flight of the belt 129 which is angled upwardly and forwardly, traveling between free rollers 126A and 126B.

Figure 6:
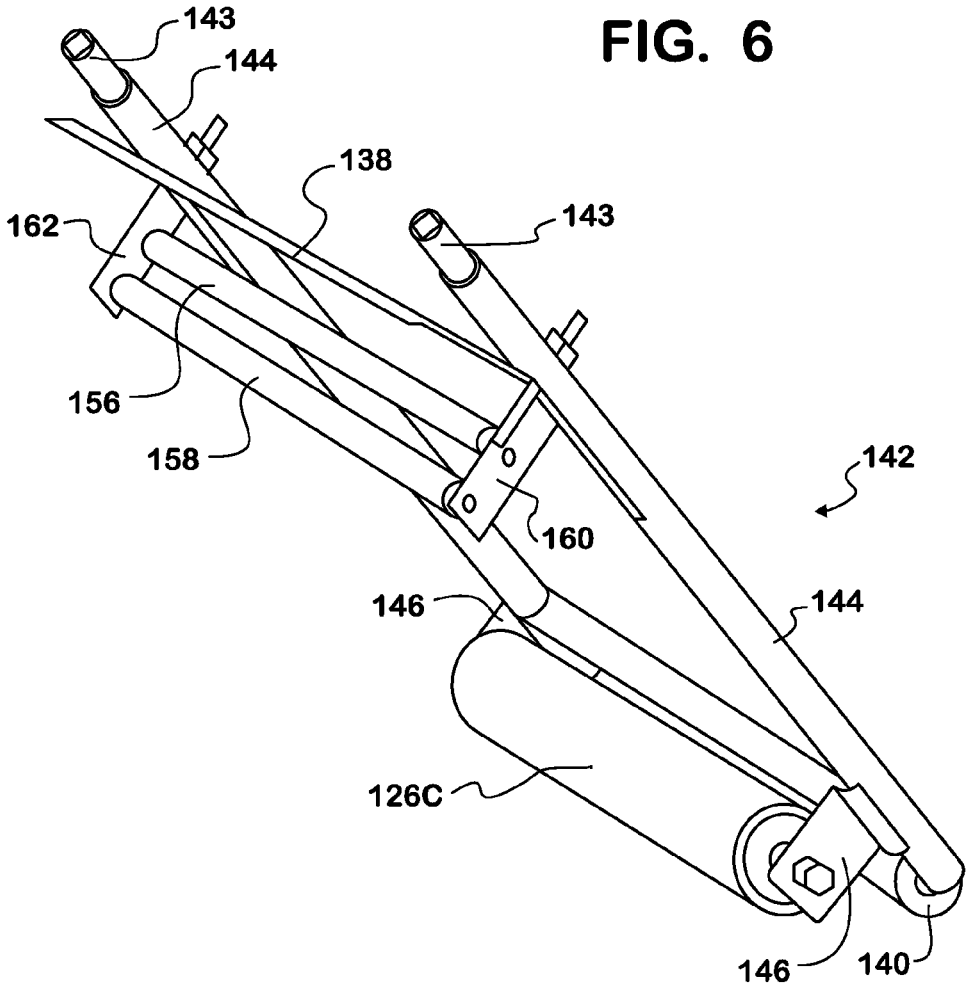
FIG. 6 is an isometric view of a belt cleaning assembly of the apparatus.

The next flight of the belt 129, flight C, is directed downwardly and forwardly into a wash tank 136 filled to an appropriate height with wash water 137, this flight C being carried by and between rollers 126B and 126C. It will be understood that the wash water tank 136 seats upon and is supported by the cross members 114, in an area between the mirror image sidewalls 112, of the framework 104. It will be understood that the wash water tank 136 is engaged to the framework 104 by passing suitable connectors (not shown) through openings 117 in end flanges 115 thereof and corresponding openings 119 in the framework 104. As the belt 129 begins this flight C, after it passes around roller 126B, toward a forward terminus of this flight C, the belt 129 is squeezed against roller 126C by a compression roller 140. Both free roller 126C and compression roller 140 are mounted to a separate frame member 142, as is the scraper 138, which frame member 142 is positioned along and above flight C, such that the compression roller 140 thereof compresses the belt 129 between roller 126C and itself to clean the belt 129 as it passes this point, which is within the wash water 137 in the wash water tank 136. The frame member 142 is illustrated in detail in FIG. 6. It engages framework 104 at free ends 143 of side frame sections 144 thereof which are received on and supported by tabs 145 of the framework 104. It will further be seen in FIG. 6 that compression roller 140 attaches directly to the frame member 142 while roller 126C depends from frame member 142 via end flanges 146.

Figure 4:
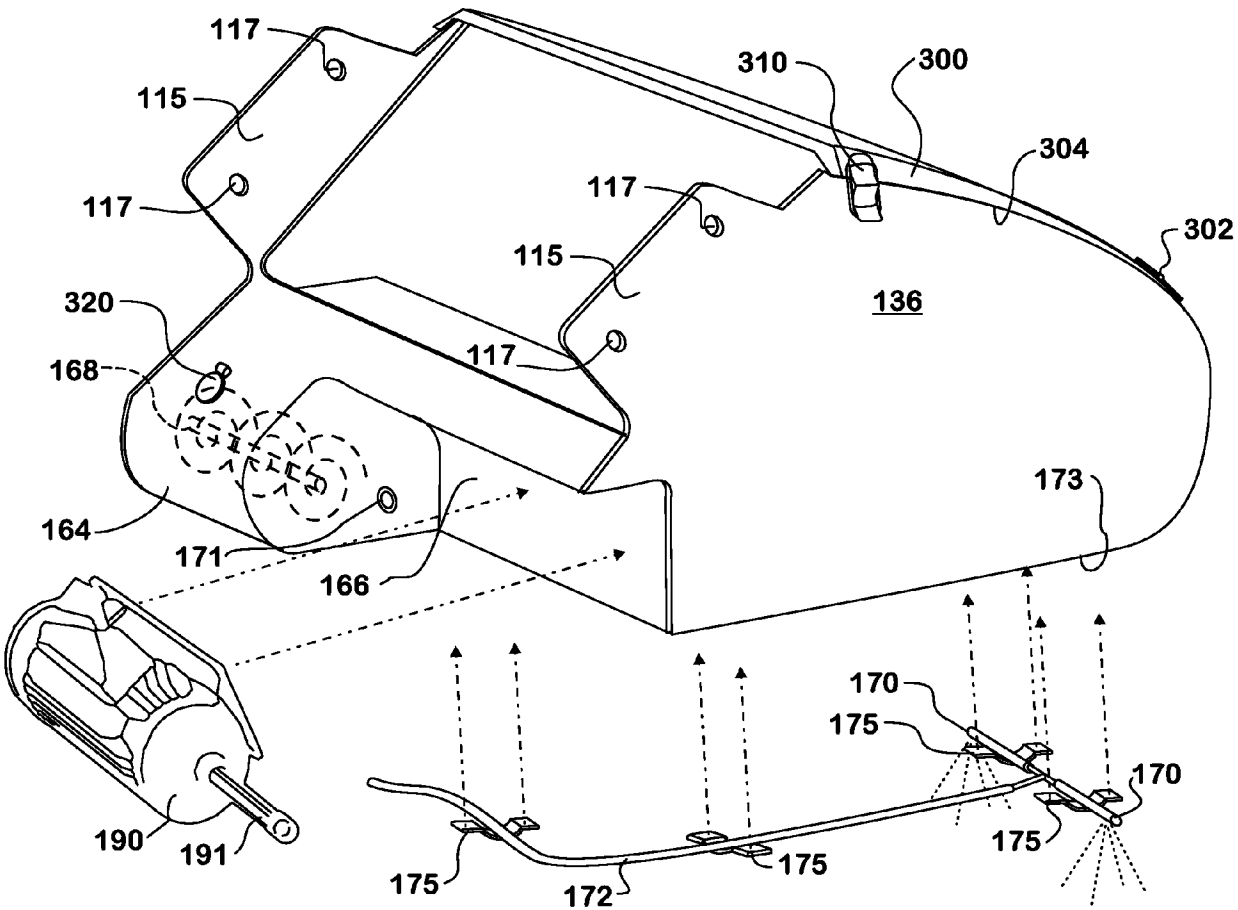
FIG. 4 is an exploded isometric view showing a wash water tank of the apparatus, to which is piggybacked a clean water tank, and showing a clean water dispensing system used to apply a spray of water to a continuous belt of the apparatus, and further showing where a motor of the device fits within a space defined alongside the clean water tank and to a rear of the wash water tank.
Figure 7:
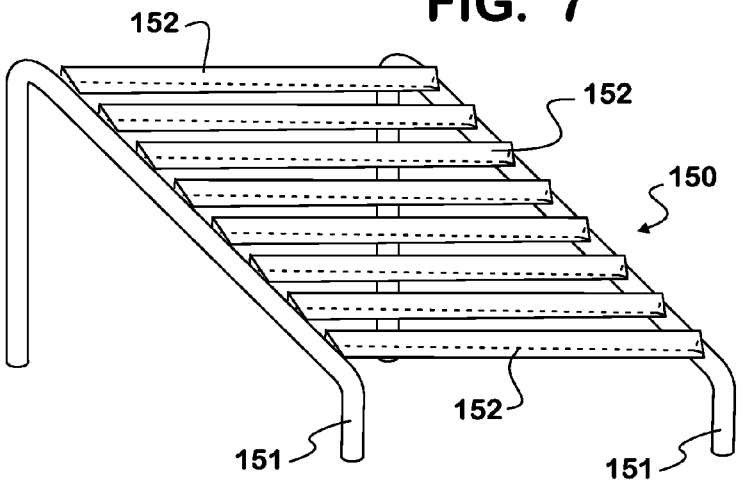
FIG. 7 is an isometric view of a belt scraping assembly of the apparatus.

The next flight D of the belt 129 now turns upwardly and rearwardly out of the wash water tank 136 carried between rollers 126C and 126D and the sponge layer 131 of the belt 129 passes across a second scraper 150, as best illustrated in FIG. 7, which scraper 150 is aligned along the flight D of the belt 129 and carries a plurality of parallel scraping elements or squeegees 152 which remove any remaining grout within the wash water 137 within the wash water tank 136, leaving the removed grout in the wash water tank 136. As the belt 129 exits the wash water 137 on its way up to roller 126D from roller 126C in the wash water tank 136, it is passed between a pair of cooperating compression rollers 156 and 158 (FIG. 6) which depend from the frame 142 by end flanges 160 and 162 at a desired position where the belt 129 is now above the level of the water 137 in the wash water tank 136, squeezing water from the sponge layer 131 of belt 129 back into the wash water tank 136. In FIG. 13 the belt exterior 130 is further scraped to remove excess water through a water scraper 138 of FIG. 6. The belt 129 then takes flight E carried between rollers 126D and 126E downwardly and rearwardly, behind and outside of the wash water tank 136. Flight F next carries the belt 129 between free roller 126E and driven roller 128, forwardly. During this flight F of the belt 129, water is propelled from a clean or fresh water tank 164 mounted along a portion of a rear wall 166 of the wash water tank 136 by an internal turbine 168 within the clean water tank 164, as shown in phantom in FIG. 4 and is sprayed onto the belt 129 passing under the wash water tank 136 by a plurality of spay nozzles 170 which engage an outlet 171 of the fresh water tank 164 by tubing 172, suitably engaged to and along a bottom surface 173 of the wash water tank 136, such as by clips 175, as best illustrated in FIG. 4. The turbine 168 constantly pumps through the tubing 172 from the outlet 171 from the fresh water tank 164 to which the tubing 172 is suitably connected, in water tight manner. This fresh water spray from spray nozzles 170 ensures that the belt 129 is wet when it takes its next flight, flight A, to clean grout off the surface 132 of the tiles 133 therebeneath.

It will be understood, of course, that the apparatus 100 must be powered in order to be functional. This power may be provided by means of connection to an AC circuit, such as by an electrical cord 174 having a plug 176 at a free end 178 thereof, as illustrated in FIG. 1, for engaging an electrical receptacle (not shown). The cord 174 engages an on/off switch 180 and from the switch 180, power is provided to the turbine 168 in the fresh water tank 164 and to a motor 190 which drives the belt 129. The motor 190 is suitably attached to the framework 104 and is seated behind the wash water tank 136 and to one side of the fresh water tank 164. A drive axle 191 of motor 190 rotates a drive gear 192 for driving the driven roller 128 the belt 129. In a preferred embodiment, a drive chain 194 extends from the drive gear 192 to a driving gear 193 of the driven roller 128 for driving the belt 129 through its various flights already defined.

It will also be understood that the compression plate or platen 134 which depends from and is engaged to the chassis 102, presses against the belt 129 to maintain its position against the underlying tile surface 132 such that the spongy layer 131 of the belt 129 rubs against the top surface 132 of the tiles 133 therebeneath to remove any grout on the tile surface 132 when the apparatus 100 is in its work position. It will also be understood that the platen 134 and belt 129 are elevated above the underlying surface when the apparatus 100 is in its transport position. It will still further be understood that this tile surface 132 cleaning takes place at a position downstream of a grout application system 200, to be defined hereinbelow.

Turning now to FIG. 7 there is illustrated therein in greater detail the ramped belt scraper 150 which, as shown in FIG. 3, underlies a lowermost portion of the flight of D the belt 129, the scraper 150 having a frame 151 angled at an angle identical to that of the flight D. As the belt 129 travels along this flight D, and the sponge layer 131 scrapes along a top surface of the scraper 150, wherein a plurality of parallel wipers or squeegees 152 positioned across the top surface of the scraper 150 scrape away any remaining grout from the belt 129 before it exits the wash water 137 in the wash water tank 136.

An enlarged perspective view of the compression plate or platen 134, as shown in FIG. 8, is mounted along an underside of the chassis 102 of the apparatus 100, by means of partially threaded corner mounts 154 which extend through cooperating openings (not shown) in opposite bottom side rails 156 of the chassis 102. Desired relative vertical positioning of the platen 134 is assured by engagement of the bottom side rails 156 between two connectors 158, such as nuts 158, positioned along each corner mounts 154, connectors 158 being positioned above and below the bottom side rails 156 of the chassis 102. The platen 134 extends across the width of the belt 129 and is positioned to ensure that the belt 129 is pressed against the underlying surface 132 when the apparatus 100 is in its work position, supported on wheels 120 and 122, as shown in FIG. 1. By means of the pressure applied against the belt 129 and thus the surface 132 of the tiles 133 therebeneath, a thorough removal of any excess grout remaining on the tile surface 132 after application of grout thereover by grout application system 200.

Figure 9:
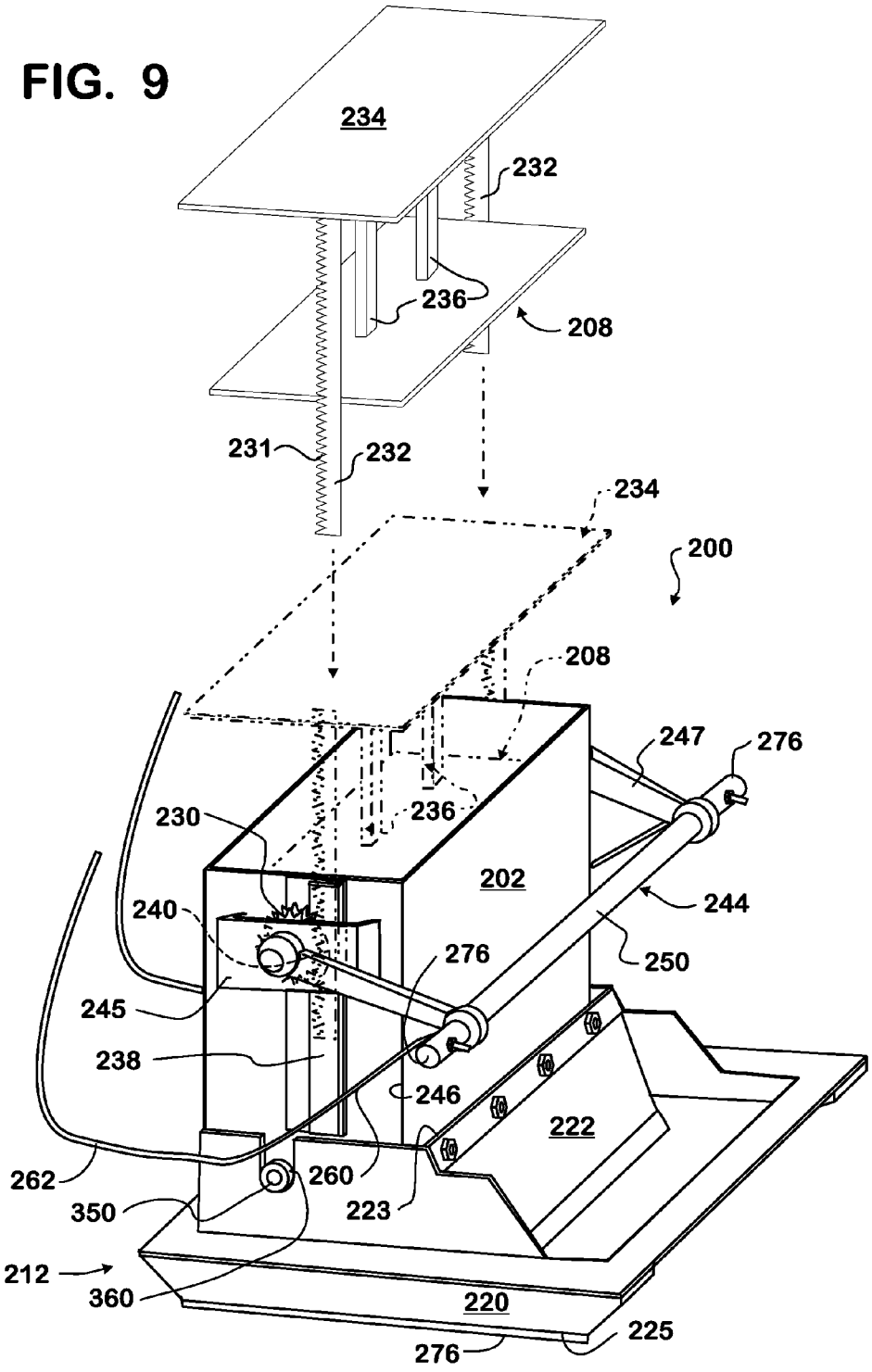
FIG. 9 is an isometric view of the grout applicator of the apparatus.
Figure 10:
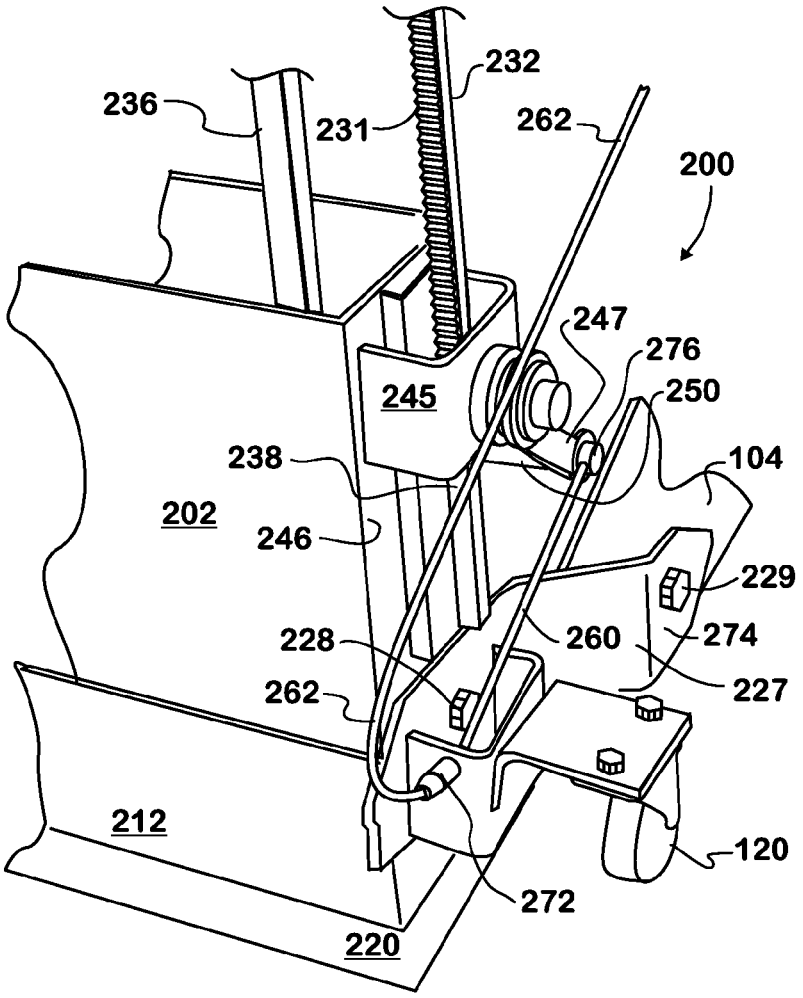
FIG. 10 is an isometric view of a portion of the grout applicator showing how same is engaged to the framework of the apparatus.

The grout installation apparatus 100 also includes the grout application system 200, as best illustrated in FIGS. 9-11. The grout application system 200 includes a grout tank 202 into which grout 204, to be applied into spaces 205 between tiles 133, is placed. This grout tank 202 includes a cooperating removable piston or plunger 208 which is positioned within the grout tank 202 and used to push the grout 204 down and out of grout tank 202, into the spaces 205 between the tiles 133, when activated. A grout dispensing head 212, in the form of a sled 212, engages about a bottom portion of the grout tank 202 and is pressed against the tile surface 132 and used to apply grout 204 into the spaces 205 between the tiles 133. The grout application system 200 is necessarily positioned upstream of the relative position at which the belt 129 under platen 134 contacts the tile surface 132 and to clean any grout from the surface 132 of the tiles 133. The grout dispensing head 212 includes a sled frame 220 which rides along the top surface 132 of the tiles 133, the sled frame 220 acting to push to the grout 204 into the spaces 205 between the underlying tiles 133. The sled frame 220 further preferably includes a flexible material for rigidity with a rubber exterior, angled wiper blade 222 along a trailing edge 223 of the grout tank 202 which wipes a significant amount of grout 204 from tile surfaces 132. The wiper blade is composed of a flexible metal attached to a rubber exterior 206 of FIG. 11 used to remove the excess grout, further pushing the grout 204 into spaces 205 between the tiles 133, when the apparatus is in its work configuration, this configuration forcing sled 212 into pressurized contact with the surface 132 therebeneath. It will also be seen that the grout tank 202 is engaged to one end of support flanges 227 to either side, which also carry the wheels 120 thereof, by means of securement structures such as bolts 228. Further it will be seen that an opposite end of the support flanges 227 are engaged to the framework 104 by bolts 229.

In order to push grout 204 downwardly out of the grout tank 202, the removable piston 208 must be operable to move down into the grout tank 202, as needed. This is accomplished through use of ratchet gears 230 which engage with teeth 231 of toothed end edge flanges 232 provided on the piston 208. These toothed end flanges 232 attach to and depend from an upper plate 234 of the piston 208, which upper plate 234 is spaced above and suitably engaged to the piston 208, such as by rods 236. The toothed end edge flanges 232 slide into tracks 238 provided to either side of the grout tank 202. Each track 238 has an opening 240 therein, with the openings 240 to either side of the grout tank 202 mirroring each other. Extending into each opening 240 in each side track 238 are teeth 241 of a cooperating ratchet gear 230 which engages a pivotable handle 244, the pivotable handle 244 being mounted pivotably onto end flanges 245 of side edges 246 of the grout tank 202. When the pivotable handle 244 is pivoted, it moves the ratchet gears 230, which in turn pulls the toothed end flanges 232 of the piston 208 downwardly, pushing grout 204 downwardly out of the grout tank 202 into the containment sled 212. It will be understood that the handle 244 comprises two sections 247, one at each side edge 246 of the grout tank 202, the sections 247 being joined together by a cross rod 250, so that they act in unison, pushing grout 204 evenly out of the grout tank 202.

Actuation is accomplished through use of actuating wires or cables 260 which extend through casings 262 from a handle 270 of the apparatus 100, as best shown in FIG. 1, through a wire nut 272 attached to each support member 274 for the grout tank 202, which support members 274 engage the grout tank releasably to the framework 104 of the apparatus 100, as best illustrated in FIG. 10. From the wire nuts 272, each actuating wire 260 extends into a suitable connection with an end 276 of the pivotable handle rod 250. When more grout 204 is required to be extruded from grout tank 202, an operator moves a pivotable lever 280 on the handle 270 of the apparatus 100 (FIG. 1) from which the actuating wires 260 extend, moving the handle 244 and causing actuation of the ratchet gears 230, pushing the piston 208 further into the grout tank 202, and delivering another dose of grout 204 into the sled 212.

In FIG. 11, a longitudinal cross sectional view through the grout application system 200 is provided to show how the grout 204 is forced out of the grout tank 202 by the piston 208 which is actuated by the teeth 241 of the ratchet gears 230 acting in cooperating with the teeth 231 of toothed end flanges 232 of the piston 208 to force the grout 204 out of the tank 202 and into the containment sled 212 therebeneath, which acts first to contain the grout within the area defined by walls 220 of the sled 212 and further shows a flexible squeegee 222 of the sled 212, composed of a flexible material for rigidity with a rubber exterior, along a trailing surface 223 of the grout tank 202, to scrape a significant amount of grout 204 which may be left behind on the tile surfaces 132, and acting as a first tile surface 132 cleaning element 222. The sled 212 is necessary because the grout 204 being extruded from the grout tank 202 by the piston 208 must be contained in some manner so that filling of the spaces 205 between the tiles 133 is assured. Through provision of the limiting or containment sled 212, the grout 204 is not allowed to flow about at will in any direction, but is rather downwardly directed within the area of containment provided by the sled 212 and scraped into the spaces 205 between the underlying floor tiles 133 by the flexible trailing squeegee 222. Also, if desired, a bottom surface 225 of the sled 212 may be covered with a spongy coating 226 to ensure that the grout is firmly pressed into the spaces 212, as well as providing a further assist in removing grout from the tile surfaces 132 therebeneath.

It has been stated previously that the belt 129 is created from a carrier layer 130 and a spongy layer 131. The manner in which to create a continuous belt is known and any suitable method may be utilized here. In FIG. 12, the carrier layer 130, preferably made of rubber, is shown to be suitably engaged to the spongy layer 131 by an adhesive 298, which is preferably not affected by water. On the other hand, as shown in FIG. 13, it is seen that the carrier layer 130 and spongy layers 131 may also be engaged by other suitable means, such as by the use of a suitable hook and loop connection means 299 between the layers 130 and 131. These are merely exemplary and should not be construed as limiting.

With a perusal of FIG. 4, it will be understood that the wash water tank 136 must be filled with wash water prior to use. To this end, the wash water tank 136 is provided with a large cover 300 which pivots about hinges 302 positioned along a top surface 304 of the tank 136 in a manner to allow for containment of the wash water 137 therein to a point just below where the hinges 302 are positioned. Also, to maintain the wash water 137 within the wash water tank 136, the cover 300 is latched to the wash water tank 136 by latches 310, one to either side of the wash water tank 136.

Likewise, it will be understood that fresh water must be installed within the fresh water tank 164 and to that end, the fresh water tank 164 must also be provided with the fill port 320, such as covered fill port 320, also shown in FIG. 4.

In use, the apparatus 100 is moved to a location at which it is to apply grout 204 into the spaces 205 between tiles 133 using the transport wheels 116 and 118. The grout application sled 212 is then positioned on the underlying surface 132 at the front 111 of the apparatus 100 between the support brackets 227 and the grout tank 202 is slid into upper area, with positioning tabs 350 on each end wall 246 of the tank 202 seating within cooperating notches 360 provided in the sled 212. Then the piston 208 is positioned within the tank 202 and the transport wheels 116 and 118 are elevated, so the apparatus 100 rests on its work wheels 120 and 122. The plug 176 of the power cord 174 is then inserted into a receptacle and the apparatus 100 is turned on through activation of the switch 180, turning on the motor 190 for moving the belt 129 and powering the turbine 168 in the fresh water tank 164. The user then grasps the handle 270 of the apparatus 100 and presses down on the lever 280 thereof, actuating the ratchet gear 230 of the grout application system 200, pushing grout 204 downwardly out of the grout tank 202 and into the sled 212 which forces the grout 204 maintained contained thereby into the spaces 205 between the underlying tiles 133, with the squeegee 222 of the sled 212 scraping off a significant amount of the grout 204 on the surface 132 of the tiles 133. It will also be understood that in a preferred embodiment of the sled 212, an undersurface 225 thereof is coated with a sponge surface 226 as well, to push the grout 204 into the spaces 205.

The scraping off by the squeegee of the sled 212 is then followed by contact of the continuous belt 129 of the apparatus 100, following behind the grout application system 200, with the surface 132 of the tiles 133 over which the belt 129 travels, removing any grout remaining thereupon, with the belt 129 being washed and then returned to its cleaning of the tile surface 132 under pressure of the platen 134 pressing downward there against.

The above-described embodiment and method are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A floor grout installation system including an apparatus having:

a grout applying member for applying grout to spaces between horizontally positioned tiles therebeneath, the grout applying member being positioned at a forward end of the apparatus;

a grout removal member downstream of the grout applying member, wherein said grout removal member is operable to remove any excess grout from the surface of the tiles between which grout has been applied, said grout removal member comprising:

a continuous belt having a horizontal bottom flight, operable to rotate such that said bottom flight moves in a rearward horizontal direction, away from said grout applying member, wherein said continuous belt includes a spongy outer surface, and wherein the spongy outer surface of said bottom flight of the continuous belt contacts said surface of the tiles; and a horizontal compression platen arranged above said bottom flight and configured to press said spongy outer surface of said bottom flight of the continuous belt downwardly against said surface of the tiles such that the entire outer surface of said bottom flight contacts the tiles during grout removal.

2. The system of claim 1 wherein the belt travels along a plurality of flights.

3. The system of claim 1 wherein the belt is carried about rollers, one of which is a driven roller.

4. The system of claim 3 wherein the driven roller is driven by a drive gear rotated by the axle of a motor, and which drive gear is engaged to the driven roller by a chain.

5. The system of claim 3 wherein the belt is carried on a set of five free rollers and one driven roller.

6. The system of claim 1 wherein the belt comprises a rubber base on which said spongy outer surface is mounted.

7. The system of claim 1 wherein the belt passes through a wash water tank along flights thereof to remove grout engaged to the spongy outer surface thereof.

8. The system of claim 1, further comprising a fresh water tank in fluid communication with a spray dispenser, wherein said spray dispenser is used along one flight of the belt to wet the spongy outer surface thereof prior to moving of the belt along the surface of the tiles to remove excess grout therefrom.

9. The system of claim 1 wherein the grout applying member comprises a grout tank into which grout is placed and a cooperating grout dispensing member which forces grout out of the grout tank and into spaces between tiles therebeneath when actuated.

10. The system of claim 9 wherein the grout applying member further includes a grout dispensing head for applying grout between tiles at a front end of the apparatus, wherein the grout dispensing member forces grout out of the grout tank and into the grout dispensing head.

11. The system of claim 10 wherein the grout dispensing member comprises a piston which pushes grout downwardly out of the grout tank into the grout dispensing head.

12. The system of claim 11 wherein the grout tank includes a pivotable handle engaged to a ratchet gear on either end edge thereof.

13. The system of claim 12 wherein the pivotable handle of the grout tank is engaged to actuating members for pivoting the handle, the actuating members being operable from a handle of the apparatus, located at a rear of the apparatus.

14. The system of claim 12 wherein the piston includes toothed end edge flanges which engage within tracks for same along side walls of the grout tank.

15. The system of claim 14 wherein the ratchet gears extend into the tracks and engage the toothed end edge flanges of the piston.

16. The system of claim 12 wherein the piston is pulled downwardly against the grout by the ratchet gears engaging teeth of the toothed end edge flanges of the piston when the pivotable handle is actuated to ratchet the ratchet gears.

17. The system of claim 10 wherein said grout dispensing head includes a containment sled which slides along the tile surface, and further includes a flexible squeegee along a trailing edge of the grout tank which moves grout off the tile surface and into spaces between tiles.

18. A floor grout installation system including an apparatus having:

a grout applying member for applying grout to spaces between horizontally positioned tiles therebeneath, the grout applying member being positioned at a forward end of the apparatus;

a grout removal member downstream of the grout applying member, wherein said grout removal member is operable to remove any excess grout from the surface of the tiles between which grout has been applied, said grout removal member comprising:

a continuous belt having a horizontal bottom flight, operable to rotate such that said bottom flight moves in a rearward horizontal direction, away from said grout applying member, wherein said continuous belt includes a spongy outer surface, and wherein the spongy outer surface of said bottom flight of the continuous belt contacts said surface of the tiles; and a vertically-adjustable horizontal compression platen arranged above said bottom flight and configured to press said spongy outer surface of said bottom flight of the continuous belt downwardly against said surface of the tiles such that the entire outer surface of said bottom flight contacts the tiles during grout removal.

19. A floor grout installation system including an apparatus having:

a grout applying member for applying grout to spaces between horizontally positioned tiles therebeneath, the grout applying member being positioned at a forward end of the apparatus;

a grout removal member downstream of the grout applying member, wherein said grout removal member is operable to remove any excess grout from the surface of the tiles between which grout has been applied, said grout removal member comprising:

a continuous belt having a horizontal bottom flight, operable to rotate such that said bottom flight moves in a rearward horizontal direction, away from said grout applying member, wherein said continuous belt includes a outer surface, and wherein the outer surface of said bottom flight of the continuous belt contacts said surface of the tiles; and a vertically-adjustable horizontal compression platen arranged above said bottom flight and configured to press said outer surface of said bottom flight of the continuous belt downwardly against said surface of the tiles such that the entire outer surface of said bottom flight contacts the tiles during grout removal.

* * * * *